United States Patent [19]

Eckerdt

[11] 4,280,869

[45] Jul. 28, 1981

[54] SUCTION DEWATERING SYSTEM WITH CAM ACTUATED ADJUSTABLE SLOT

[75] Inventor: Lawrence W. Eckerdt, Glens Falls, N.Y.

[73] Assignee: Albany International Corp., Menands, N.Y.

[21] Appl. No.: 121,389

[22] Filed: Feb. 14, 1980

[51] Int. Cl.[3] ..... D21C 1/48; D21C 1/52

[52] U.S. Cl. ..... 162/252; 15/306 A; 34/160; 162/352; 162/366; 162/374

[58] Field of Search ..... 162/252, 352, 363, 364, 162/366, 374; 210/406; 15/302, 306 A, 415 R; 34/43, 92, 155, 160

[56] References Cited

U.S. PATENT DOCUMENTS

| | | | |
|---|---|---|---|
| 2,142,711 | 1/1939 | Birch | 15/306 A |
| 3,520,775 | 7/1970 | Truxa | 162/352 |
| 3,836,428 | 9/1974 | McConaughy | 162/374 |
| 3,928,125 | 12/1975 | Poeshl | 162/352 |
| 4,225,991 | 10/1980 | Bolton et al. | 15/306 A |

*Primary Examiner*—S. Leon Bashore
*Assistant Examiner*—Steve Alvo
*Attorney, Agent, or Firm*—Kane, Dalsimer, Kane, Sullivan & Kurucz

[57] ABSTRACT

A suction dewatering system including a suction device adapted to be connected to a suction source and having a longitudinal opening therein through which suction is applied. A cover is provided for the device including at least two spaced lands to be mounted to the device with the space therebetween forming a slot in alignment with the longitudinal opening in the suction device. A wear strip is removably mounted on each land and has a wear surface thereon for a medium to be passed thereover for dewatering. At least one of the wear strips is adjustable so that the shifting of each adjustable strip in the longitudinal direction causes the strip to shift laterally and vary the slot width in the direction of travel of the medium across the wear surface and varying the dwell time of the medium over the slot to which suction is being applied. A cam arm longitudinally extends in a longitudinal track in the cover. One of the cam arm and the adjustable wear strip has at least one recess with a pair of opposing walls at an oblique angle with respect to the longitudinal slot. The other of the cam arm and adjustable wear strip has a cam extending therefrom into the recess with a pair of sides conforming to the oblique walls of the recess. Controls are provided to reciprocate the cam arm in response to change in permeability of the medium over the suction device during use causing the adjustable wear strip to shift laterally and vary the slot width to change the dwell time of the medium over the slot.

12 Claims, 4 Drawing Figures

FIG. 3
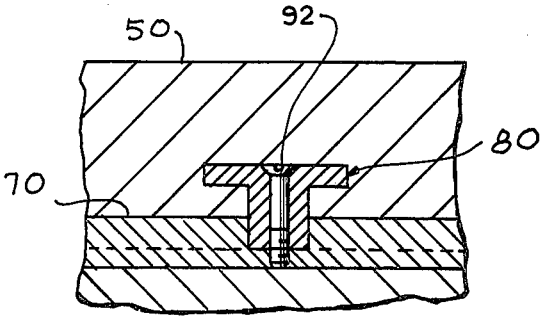
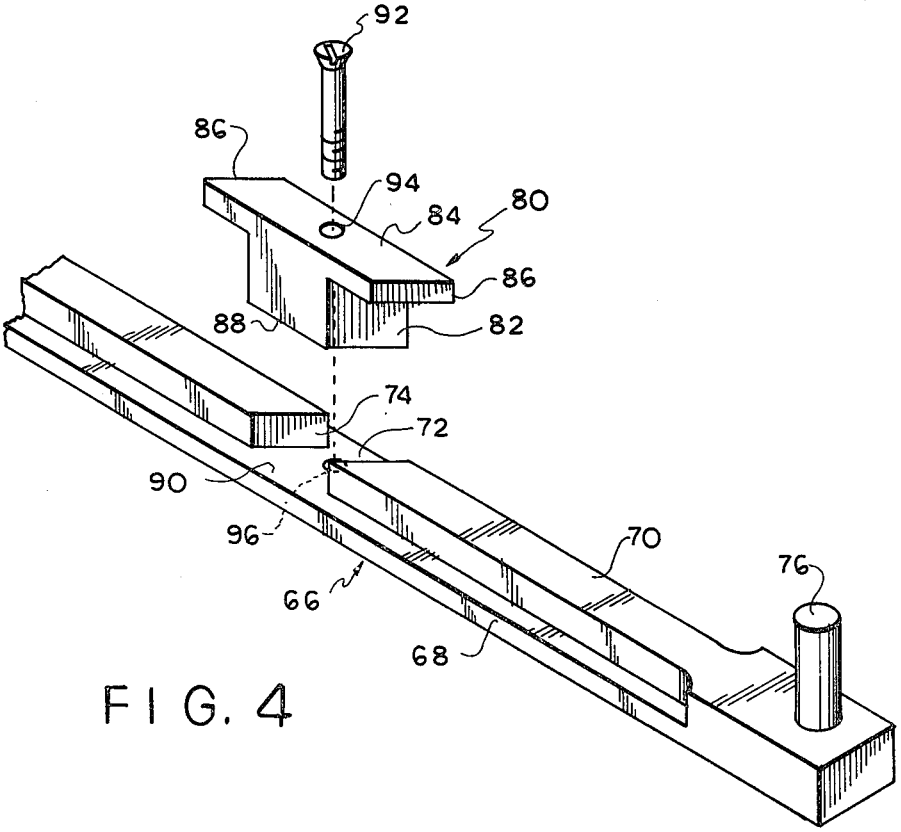
FIG. 4

SUCTION DEWATERING SYSTEM WITH CAM ACTUATED ADJUSTABLE SLOT

In many types of industrial dewatering systems mediums, such as papermaker's felts, require dewatering periodically during use. For this purpose, a variety of different types of suction dewatering systems have been developed including those which employ suction boxes or suction pipes. The pipes or boxes include a slot structure with an upper wear surface over which the medium such as a felt passes into alignment with a slot subjected to a source of suction. Water is drawn by the suction force from the felt as it passes over the slot and is collected in the box or pipe and then is disposed of in a conventional manner.

In use, as the felt or similar material ages and undergoes a physical change whereby parameters such as permeability are changed. A decrease in permeability, for example, causes a greater resistance to dewatering with increased age of the medium. Thus, the dewatering system requires modification as the felt ages in order to maintain an acceptable efficiency in the dewatering procedure. A number of different criteria are used to keep the dewatering process at acceptable efficiency level. One acceptable way of achieving the desired dewatering result as the felt ages is to increase the slot width. This provides for greater exposure of the felt to the suction force as it passes over the slot as well as increasing the dwell time of the felt over the slot and accordingly the time during which it is subjected to the vacuum and water is removed.

Presently known systems employ various acceptable manual procedures for changing slot width such as the system disclosed in U.S. Pat. No. 3,836,428. In this type of system, the manual changing of the slot size is achieved by changing the shape and configuration and sizes of portions of the slot cover. This system works effectively for the purposes discussed above, however, it does result in an interruption in the dewatering process. Naturally in a manual system, the changing process causes the dewatering rate to drop off until the slot opening is manually changed. Of course during the actual changing time the machine is not operating at all and accordingly no dewatering is taking place.

Therefore, further improvements in suction dewatering systems are desirable particularly a system which will automatically adjust tthe slot size as the felt or similar medium ages without requiring the felt to be periodically checked to determine if it is operating efficiently and without the need of shutting down the machine to manually adjust slot sizes by changing slot cover configurations.

It should also be kept in mind that the manually adjustable systems require an abrupt change in slot size rather than a gradually changing automatic adjustment. Any type of manual system that would utilize gradual change would require frequent manual slot adjustments causing frequent interruptions in the use of the machinery.

SUMMARY OF THE INVENTION

With the above background in mind, it is among the primary objectives of the present invention to provide a suction dewatering device with a suction pipe cover which is automatically adjustable in terms of the suction slot for dewatering of a medium such as a papermaker's felt.

The device is designed so that the cover has a stationary strip in terms of the felt direction and one or more automatically adjustable strips in terms of the felt direction. The adjustable strip or strips maintain a particular slot size at the beginning of the life of the medium to be dewatered and would gradually and automatically increase the slot size as the age of the medium increases. A control system senses the vacuum level in the suction device and as it increases, as it normally will over the life of the medium, the control system operates to reposition the adjustable strip and form a larger slot. This process happens simultaneously and would constantly maintain an optimum vacuum level and at the same time increase the dwell time of the medium over the suction area.

With the automatically adjustable slot of the present invention, a felt direction slot size adjustment is achieved without the necessity of removing the slot cover. Also, the automatic slot change coincides with the vacuum level in the suction device to thereby maintain optimum efficiency in the system continuously monitored over the life of the felt or similar medium. Additionally, vacuum pump requirements are minimized since dewatering efficiency is maintained at the highest possible level throughout the felt life. Thus, capital cost, and other equipment savings are readily achieved.

In summary, a suction dewatering system is provided including a suction device adapted to be connected to a suction source and having a longitudinal opening therein through which suction is applied. A cover is provided and includes at least two spaced lands with means thereon for mounting the lands to the suction device and the space therebetween forming a slot in alignment with the longitudinal opening in the suction device. A wear strip is removably mounted on each land and has a wear surface for a media to be passed thereover for dewatering. At least one of the wear strips has adjustment means thereon so that shifting of each adjustable strip in the longitudinal direction will cause the strip to shift laterally and vary the slot width in the direction of travel of the medium across the wear surface and varying the dwell time of the medium over the slot to which suction is being applied. The adjustment means includes a cam arm longitudinally extending in a longitudinal track in the cover. One of the cam arm and the adjustable wear strip has at least one recess with a pair of opposing walls at an oblique angle with respect to the longitudinal slot and the other of the cam arm and adjustable wear strip has a cam extending therefrom into the recess with a pair of sides conforming to the oblique walls of the recess. Control means is adapted to be connected to the cam arm and actuable to reciprocate the cam arm in response to change in permeability during use of the medium causing the adjustable wear strip to shift laterally and vary the slot width to change the dwell time exposure of the medium with respect to the slot.

In one embodiment of the invention, stop means is provided for the adjustable wear strip so that movement thereof is restricted to a lateral direction with respect to the slot and movement in the longitudinal direction is substantially eliminated.

With the above objectives among others in mind, reference is made to the attached drawings.

BRIEF DESCRIPTION OF THE DRAWINGS

In the Drawings

FIG. 3 is a fragmentary sectional view thereof taken along the plane of line 3—3 of FIG. 1; and FIG. 4 is a fragmentary perspective view of a portion of the cam arm of the suction dewatering system.

DETAILED DESCRIPTION

Figure 1:
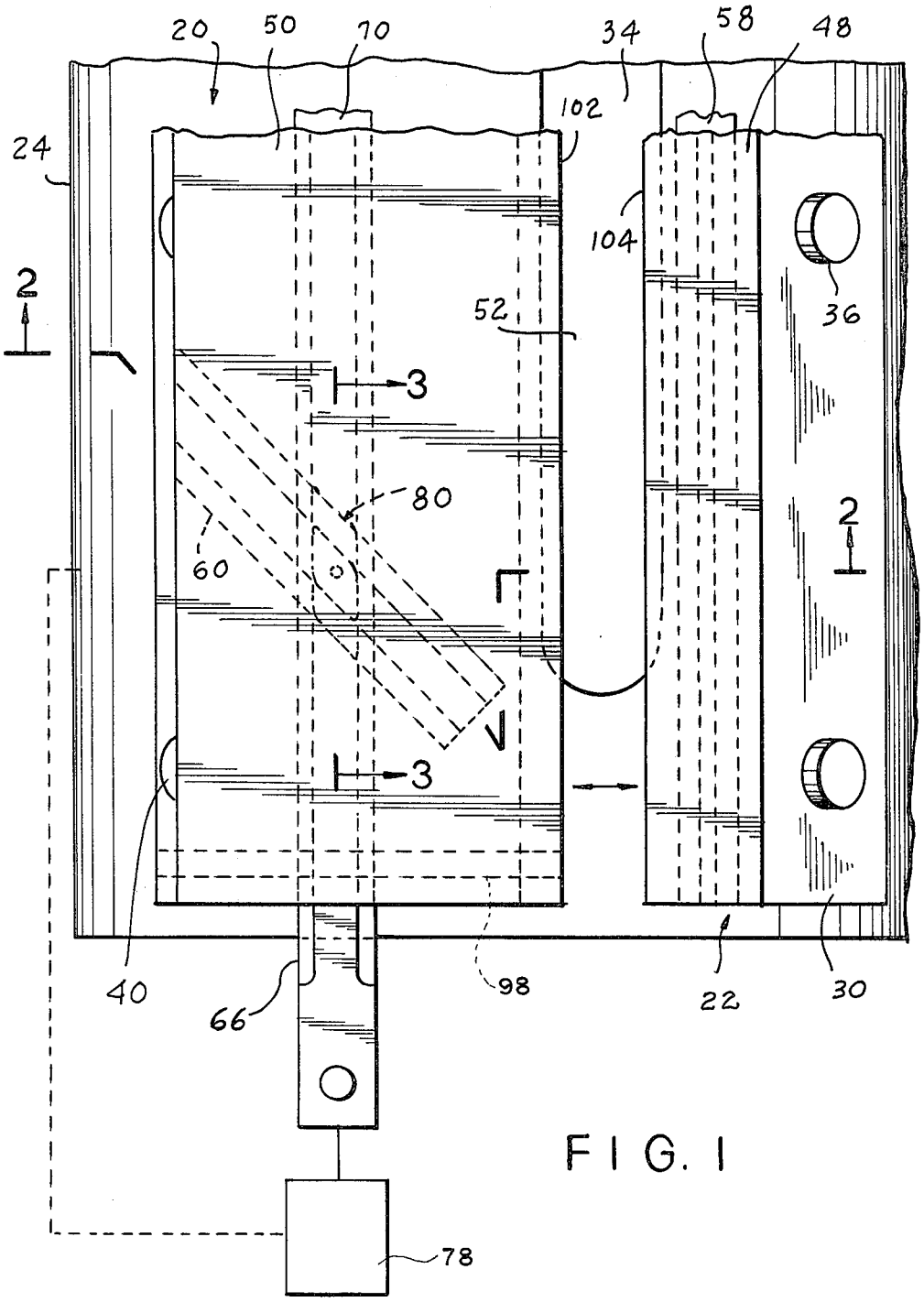
FIG. 1 is a fragmentary top plan view of the suction dewatering system of the invention.

In general the suction dewatering system 20 of the present invention is similar to that disclosed in U.S. Pat. No. 3,836,428 and in copending applications Ser. No. 100,617 filed Dec. 6, 1979 and Ser. No. 100,814 filed Dec. 6, 1979. The subject matter of the above patent and applications is incorporated herein by reference.

The area of improvement of the present invention resides in the structure of the cover 22 of the suction dewatering system 20. The cover structure 22 is mounted to a well known type of suction pipe 24 having a hollow interior 26 connected at one end to a source of suction in a conventional manner (not shown). Pipe 24 has a longitudinal slot 28 in its upper surface portion communicating with the hollow interior 26 and accordingly subjected to the same source of suction. Cover 22 is mounted to pipe 24 so that it is in predetermined alignment with respect to longitudinal slot 28. In the depicted embodiment the cover 22 includes a pair of spaced lands 30 and 32 which extend along the length of pipe 24 at least as long as the length of longitudinal slot 28. Lands 30 and 32 are spaced from one another to provide a longitudinal opening 34 therebetween in alignment with slot 28 and in communication therewith. Land 30 is mounted to pipe 24 in fixed position in a conventional manner such as by the use of spaced threaded bolts 36 threadedly interengaged with threaded apertures 38 in the pipe. In a similar manner, land 32 is mounted in fixed position on pipe 24 by means of bolts 40 threaded into threaded apertures 42 of the pipe. As shown, bolts 40 and 36 are spaced along the length of lands 32 and 30 respectively to anchor the lands along the length of pipe 24.

An elongated stationary wear strip 44 is removably mounted on land 30 and an elongated adjustable wear strip 46 is removably mounted on land 32. The upper surface 48 of wear strip 44 forms a wear surface for a medium to be passed there across such as a papermaker's felt for dewatering purposes. The upper surface 50 of adjustable wear strip 46 forms a similar surface for the medium. The wear strips 44 and 46 are spaced from one another to provide an aperture 52 therebetween in alignment with opening 34 and slot 28 to provide the continuous longitudinal slot for communication between the interior 26 of pipe 24 and the upper surface of the device 20 so that suction applied therethrough will dewater the medium passing across wear surfaces 48 and 50 and over opening 52 therebetween.

Wear strip 48 is mounted to the upper surface of land 30 by means of an I-shaped anchor member 54. Anchor member 54 is positioned so that the T-shaped bottom portion 56 is positioned in a similar mating T-shaped recess in the upper portion of land 30 and the other T-shaped half 58 of the anchor member 54 is positioned in a mating T-shaped recess in the undersurface of wear strip 44. Wear strip 44 is positioned on upper portion 58 of the anchor member by sliding it on from one end and can be removed in the same manner. Once mounted wear strip 44 is in fixed position with respect to the direction of travel of the medium thereacross as shown by the arrows in FIG. 2.

Adjustable wear strip 46 is positioned on the upper surface of land 32 and in the embodiment shown is of greater width than the stationary wear strip 44. The undersurface of wear strip 46 contains a variety of spaced oblique slots 60 which are angularly disposed with respect to the slot 34. The upper surface 62 of land 32 contains a T-shaped recess 64 in which the bottom portion of a cam arm 66 is slidably disposed. Recess 64 extends longitudinally substantially parallel to slot 34 and accordingly permits the sliding of cam arm 66 reciprocally in the same manner. The cam arm as shown in FIG. 4 has a larger rectangular bottom base 68 and a smaller width top portion 70. At predetermined intervals along the top portion 70 are notches 72 which are open in a lateral direction and contain a pair of opposing oblique side walls 74 in the longitudinal direction.

The proximal end of arm 66 contains an upstanding bar 76 adapted to be connected to the control means 78. The control means is of a conventional nature and can be mechanical, pneumatic or electrical sensing a change in vacuum in the system and actuating cam arm 66 through attachment to projection 78 to reciprocate the cam arm and adjust the slot.

Each notch 72 is coupled with a cam 80. The cam has a lower body portion 82 with a pair of opposed oblique sides conforming to the oblique sides 74 of notch 72 so that the bottom body portion can fit into notch 72. Extending upward from body portion 82 is a cam projection 84 which extends longitudinal beyond the oblique end walls of the lower body portion 82. The cam projection 84 terminates in a longitudinal direction in a pair of oblique edges 86. The angle of oblique edges 86 generally conforms to the oblique sides of body portion 82 and also to the oblique sides 74 of notch 72. The width of cam member 80 including the body portion 82 and the upper cam projection 84 is the same and conforms to the width of portion 70 of cam arm 66. When each cam 80 is inserted in a notch 72 its bottom surface 88 will seat on an exposed upper surface 90 of botton base 68 of cam arm 66 at the base of a notch 72. A cam 80 is provided for each notch 72 along the length of cam arm 66. The cam 80 is fixed in position by means of a threaded screw 92 passed through aligned aperture 94 in the cam and a threaded aperture 96 in the bottom base 68 of cam arm 66. In this manner, cam 80 is fixed to cam arm 66 to reciprocate therewith. The undersurface of the longitudinal projecting portions of cam projection 84 engages with upper surface of portion 70 of the cam arm and extends longitudinally away from the notch 72. This extending projection 84 forms the cam drive surface for the wear strip. It is dimensioned to fit into an oblique slot 60 and reciprocate therein whereupon it will engage the oblique side walls of the slot 60 and force wear strip 46 laterally in both directions depending upon the direction of reciprocation.

An end stop rib 98 is positioned at the ends of cover 22. The end stop rib forms a stop means to prevent longitudinal movement of the wear strip 46 when cam arm 66 is reciprocated. Thus, the only movement of the wear strip would be transverse or lateral with respect to the slot 52. A suitable notch 100 is positioned in the underside of wear strip 46 adjacent to inner edge 102 to provide for sufficient play for lateral movement in adjusting the position of the wear strip 46. The end stops 98 are provided with suitable openings to permit passage of the cam arm 66 therethrough as it reciprocates.

Figure 2:
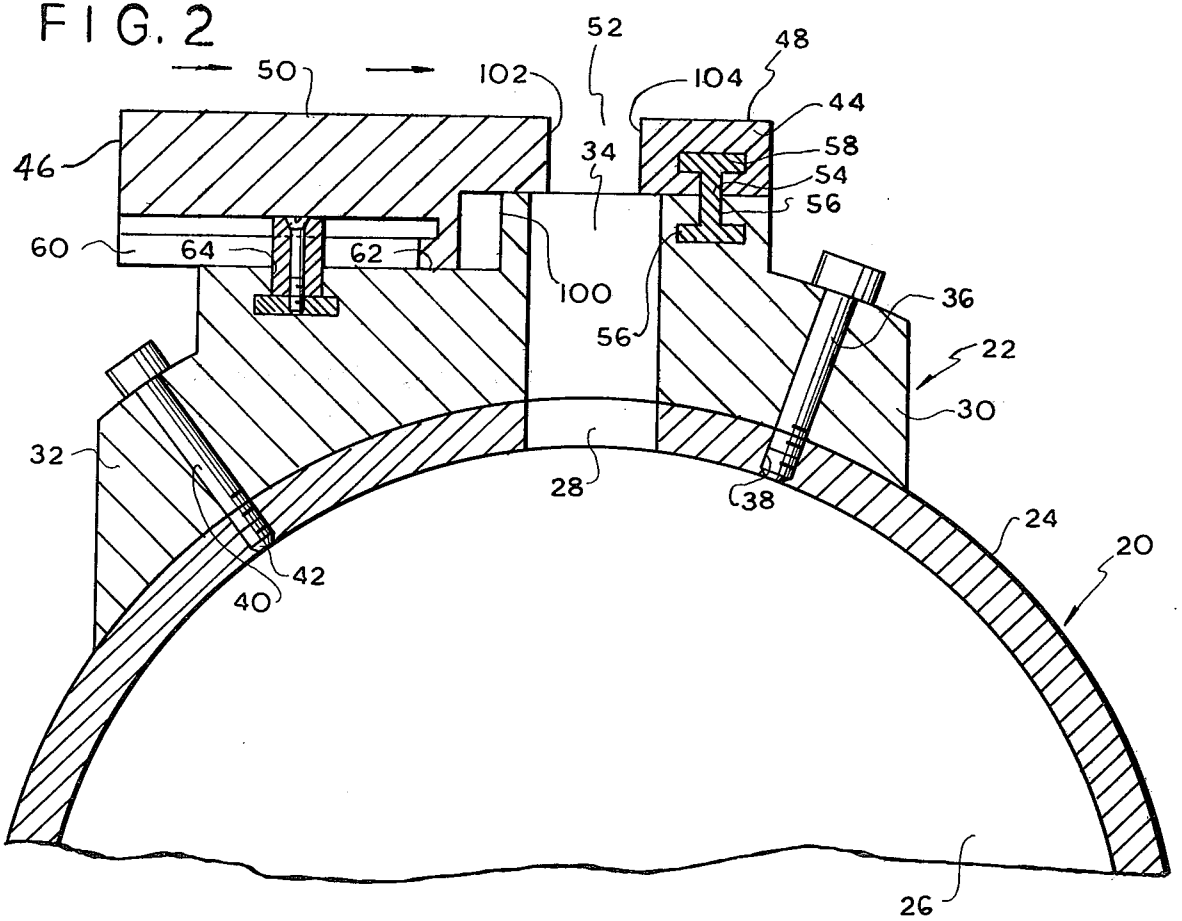
FIG. 2 is a sectional view thereof taken along the plane of line 2—2 of FIG. 1.

In use, a medium such as a papermaker's felt is arranged to pass laterally over the suction dewatering system 20 in the direction of the arrows of FIG. 2. When the medium is new it has a greater permeability and is less resistant to air flow. With this in mind, in the present system, it is desirable to have opening 52 as small as possible. Accordingly, control means 78 is used to shift cam arm 66 in the direction away from the control means in FIG. 1 and longitudinally with respect to the cover 22. This causes oblique edges 86 on cam 80 to apply a force to the inner walls of oblique slot 60 with respect to each cam on the undersurface of adjustable wear strip 46. The angle of the slot 60 and the direction of force causes the wear strip 46 to move inwardly with respect to opening 52 so that the inner surface 102 is brought closer to the opposing inner surface 104 of stationary wear strip 48. This reduces the size of opening 52 and accordingly the sides of the slot through which suction is applied to the felt moving across the structure.

During use, the felt develops reduced permeability thus increasing resistance to air flow. Accordingly, the vacuum in pipe 24 increases. This increase in vacuum is monitored and senses in a conventional manner by control means 78. A conventional type of sensor can be used for this purpose and then a conventional type of actuator as part of control means 78 in engagement with projections 76 will respond and reciprocate cam arm 66 toward the controls 78 as shown in FIG. 1. This causes the oblique edges 86 to engage the obliquely angled walls of slot 60 for each cam and slot arrangement and force the adjustable wear strip 46 laterally outward away from opening 52. Wear strip 46 is prevented from moving in the longitudinal direction as cam arm 66 is moved in that direction by use of the stop means in the form of lateral end projection 98. This end projection 98 engages with the end of the wear strip 46 and restricts its movement to a reciprocating lateral movement.

This action widens slot opening 52 and accordingly increases the slot size. Therefore, as the dewatered felt becomes more resistant to air flow with increased age, the increased slot size increases the exposure or dwell time of the felt to the vacuum area providing for improved dewatering over the life time of the felt. Control system 78 which responds to this vacuum condition in pipe 24 and actuates the reciprocating cam arm is a conventional system of controls well known in the art. They can be mechanical, electrical, pneumatic or a combination thereof. The suction source (not shown) can be any type of conventional well known mechanism in the field such as a centrifugal exhauster, a liquid ring pump or any conventional substitutes well known in the field.

Naturally if a centrifugal exhauster is used the vacuum level will not increase significantly with a decrease in the felt permeability. Therefore, the controls are used to sense a change in air flow requirements and the slot size is increased to maintain the air flow at essentially a constant vacuum. In all other respects the dewatering device with a centrifugal exhauster works the same as when used with other suction sources such as a liquid ring pump. The only difference is the presence of a sensor to determine changes in air flow requirements to initiate an increase in slot width in place of a sensor to sense the vacuum level in the suction device and increase the slot width accordingly.

Of course in alternative forms, the location of the longitudinal slot, the cams and the receiving recesses for the cams can be interchangeably located on the wear strip, reciprocating cam arm, and the land. Operation of the alternative forms would result in the same effective result as discussed in connection with the above described embodiment. The cam arm moves longitudinally causing the adjustable wear strip to move laterally to adjust the slot size opening.

Suction dewatering device 20 with one or more stationary wear strips and one or more adjustable wear strips is automatically adjustable in terms of the felt direction of travel. The adjustable strip or strips maintain a particular slot size at the beginning of the life of the medium to be dewatered such as a papermaker's felt and gradually and automatically increase the slot size as the age of the medium increases. A conventional control system 78 senses the vacuum level in the suction device and as it increases, as it normally will over the life of the medium, operates cam arm 66 to reposition adjustable strip 60 to form a larger slot. This process happens simultaneously and constantly maintains an optmimum vacuum level while at the same time increasing the dwell time of the medium over the suction slot area.

In this manner, slot size adjustment in the direction of felt travel is accomplished without the necessity of removing any portion of the slot cover. An automatic slot changing system is provided that coincides with the vacuum level in the suction device. With the present system, vacuum pump requirements are minimized thereby providing cost saving.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

I claim:

1. A suction dewatering system comprising; a suction device adapted to be connected to a suction source and having a longitudinal opening therein through which suction is applied and the opening being positioned substantially perpendicular to the direction of material travelling across the suction device for dewatering thereof, a cover including at least two spaced lands with means thereon for mounting the lands to the suction device and the space therebetween forming a slot in alignment with the longitudinal opening in the suction device, a wear strip removably mounted on each land and having a wear surface for a material to be passed thereover for dewatering, at least one of the wear strips being automatically adjustable and having adjustment means thereon so that shifting of each adjustable strip in the longitudinal direction will cause the strip to shift laterally and vary the slot width in the direction of travel of the material across the wear surface and varying the dwell time of the material over the slot to which suction is being applied, the adjustment means including a cam arm longitudinally extending in a longitudinal track in the cover, one of the cam arm and the adjustable wear strip having at least one recess with a pair of opposing walls at an oblique angle forming an oblique track with respect to the longitudinal slot; and the other of the cam arm and adjustable wear strip having a cam extending therefrom into and mating with the oblique track, and automatic control means connectable to the cam arm and actuable to reciprocate the cam arm in response to change in conditions during use of the material causing the cam to slide in the oblique track and the adjustable wear strip to shift laterally with respect to the longitudinal slot and vary the longitudinal slot width to change the dwell time exposure of the material with respect to the longitudinal slot.

2. The invention in accordance with claim 1 wherein the longitudinal track in the cover is substantially parallel to the slot.

3. The invention in accordance with claim 1 wherein stop means is provided to prevent the adjustable wear strip from shifting longitudinally as it is shifting laterally.

4. The invention in accordance with claim 1 wherein each of the wearstrips is adjustable and each of the adjustable wearstrips has a cam arm with a cam extending therefrom and a recess positioned on the wearstrip.

5. The invention in accordance with claim 4 wherein there are a plurality of spaced cams extending upwardly along the length of the cam arm and there are a corresponding plurality of spaced obliquely angled recesses in the undersurface of each adjustable wear strip to mate with the cams.

6. The invention in accordance with claim 5 wherein the cam arm has a projecting portion extending longitudinally of the cover adapted for attachment to the control means for reciprocation of the cam arm.

7. The invention in accordance with claim 5 wherein each cam is mounted in fixed position on the cam arm and has a lower body portion extending into a body receiving recess in the cam arm, the body portion having a pair of opposing parallel walls substantially parallel to the side walls of the longitudinal cam arm and a pair of opposing oblique walls substantially parallel to the oblique recesses in the wear strip, the receiving recess in the cam arm having a pair of opposing oblique walls corresponding to the oblique walls of the body portion of the cam to receive the cam therein and being open in alignment with the two opposing walls of the body portion parallel to the longitudinal cam arm, an elongated upper portion on each cam longer than the lower body portion and terminating in a pair of oblique opposed walls mating with the opposing oblique surfaces on the recess in the wear strip, and a pair of opposing walls parallel to the longitudinal arm and parallel to and extending beyond the pair of opposing sides of the lower body portion parallel to the longitudinal arm.

8. The invention in accordance with claim 7 wherein each cam is mounted to the cam arm by means of a threaded screw extending through aligned apertures in the cam and the cam arm.

9. The invention in accordance with claim 1 wherein the control means senses an increase in vacuum in the suction device and actuate the cam arm to shift the cam arm in the longitudinal direction which will accordingly shift the adjustable wear strip in a lateral direction to thereby automatically adjust the slot width and accordingly the dwell time of the medium passing over the suction device and the longitudinal opening therein.

10. The invention in accordance with claim 1 wherein the system includes papermaking machinery with the suction device being a suction pipe and the medium to be dewatered is a felt material.

11. The invention in accordance with claim 1 wherein control means senses a decrease in air flow in the suction device and actuate the cam arm to shift the cam arm in the longitudinal direction which will accordingly shift the adjustable wear strip in a lateral direction to thereby automatically adjust the slot width and accordingly the dwell time of the medium passing over the suction device and the longitudinal opening therein.

12. A suction dewatering system comprising; a suction device adapted to be connected to a source of suction and having a longitudinal opening therein through which suction is applied and the opening being positioned substantially perpendicular to the direction of material travelling across the suction device for dewatering thereof, a cover including at least two spaced lands with means thereon for mounting the lands to the suction device and the space therebetween forming a slot in alignment with the longitudinal opening in the suction device, a wear strip removably mounted on each land and having a wear surface for a material to be passed thereover for dewatering, at least one of the wear strips automatically being adjustable by adjustment means so that shifting of the adjustment means will cause the adjustable strip to shift laterally and vary the slot width in the direction of travel of the material across the wear surface and varying the dwell time of the material over the slot to which suction is being applied, the adjustment means including a cam arm on the cover, one of the cam arm and cover having a longitudinal track and the other of the cam arm and cover longitudinally extending into the longitudinal track longitudinally extending in a longitudinal track, at least one recess with a pair of opposing walls at an oblique angle forming an oblique track with respect to the longitudinal slot; and a cam extending into and mating with the oblique track, and automatic control means connectable to the cam arm and actuable to reciprocate the cam arm in response to changing conditions during use of the material causing the cam to slide in the oblique track and the adjustable wear strip to shift laterally with respect to the longitudinal slot and vary the longitudinal slot width to change the dwell time exposure of the material with respect to the longitudinal slot.

* * * * *